US008032983B2

(12) United States Patent
Griffith et al.

(10) Patent No.: US 8,032,983 B2
(45) Date of Patent: Oct. 11, 2011

(54) DUST CUP LATCH FOR CYCLONE SEPARATOR VACUUM

(75) Inventors: Aaron P. Griffith, Grand Rapids, MI (US); Wing Shun Luk, Hong Kong (CN); Gabriel S. Vander Baan, Ada, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 818 days.

(21) Appl. No.: 12/121,026

(22) Filed: May 15, 2008

(65) Prior Publication Data

US 2008/0282497 A1 Nov. 20, 2008

Related U.S. Application Data

(60) Provisional application No. 60/938,583, filed on May 17, 2007.

(51) Int. Cl.
*A47L 9/10* (2006.01)

(52) U.S. Cl. ..... 15/347; 15/353

(58) Field of Classification Search ..... 15/347, 15/352, 353, 323; 55/DIG. 3, 429
See application file for complete search history.

(56) References Cited

U.S. PATENT DOCUMENTS

| | | | | |
|---|---|---|---|---|
| 6,732,406 | B2 | 5/2004 | Oh | |
| 6,735,816 | B2 | 5/2004 | Oh et al. | |
| 6,782,584 | B2 * | 8/2004 | Choi | 15/352 |
| 6,991,667 | B2 * | 1/2006 | Yang et al. | 55/429 |
| 7,191,490 | B2 | 3/2007 | Lee et al. | |
| 7,578,027 | B2 * | 8/2009 | Kim | 15/352 |
| 2002/0029436 | A1 | 3/2002 | Hawkins et al. | |
| 2004/0261216 | A1 * | 12/2004 | Choi et al. | 15/352 |

* cited by examiner

*Primary Examiner* — Dung Van Nguyen
(74) *Attorney, Agent, or Firm* — McGarry Bair PC

(57) ABSTRACT

A latching mechanism for the dust cup assembly on a bottom exit cyclone-separator vacuum cleaner, including a non-rotating annular seal member supporting the dust cup assembly above a discharge outlet, and a U-shaped slide lock member movable in and out underneath the dust cup assembly to raise and lower the seal member, thus raising and lower the dust cup assembly into and out of engagement with a cyclone separator chamber.

15 Claims, 7 Drawing Sheets

DUST CUP LATCH FOR CYCLONE SEPARATOR VACUUM

CROSS-REFERENCE TO RELATED APPLICATIONS

This application claims priority to U.S. Provisional Patent Applications Ser. No. 60/938,583, filed May 17, 2007, all of which is incorporated herein by reference.

BACKGROUND OF THE INVENTION

1. Field of the Invention

The present invention is in the field of vacuum cleaners that use cyclone separators with removable debris-collecting receptacles.

2. Description of Related Art

Upright vacuum cleaners that use cyclone action to separate dust and dirt from the airflow through the vacuum cleaner are well known. A mechanical issue addressed by the prior art is how to secure and release the reusable dirt- and dust-collecting receptacle ("dust cup") that sits under the cyclone chamber.

U.S. Pat. No. 7,191,490 to Lee et al. discloses a top exit cyclone assembly including soil collection receptacle at a lower portion thereof and having a sliding groove formed on the bottom surface that confronts the floor of an accommodation recess on the handle. A guide member is located at the lower end of the soil collection receptacle, wherein the guide member is formed with a pair of guide projections at opposite sides and an operation lever adapted to move the guide member up and down to raise and lower the soil collection receptacle in sealing relation to the cyclone assembly. The guide member moves up and down as the operation lever is pushed and pulled horizontally relative to the handle.

U.S. Pat. No. 6,732,406 to Oh shows a removable dust cup ("barrel") that slides out from under the cyclone chamber to be emptied. The dust barrel is locked in place and released by a rotating handle that directly engages a slanted, spiraling recess on the bottom of the dust barrel. Rotating the handle in a first direction raises the dust barrel toward the bottom of the cyclone chamber, locking the barrel in place; rotating the handle the opposite direction lowers the dust barrel from the cyclone chamber for emptying.

U.S. Pat. No. 6,735,816 to Oh et al. shows a similar removable dust cup ("container") raised and lowered into and out of engagement with the cyclone chamber by a rotating lever. The rotating lever raises and lowers the dust cup through an intermediate, non-rotating locking disc operating against the bottom of the dust container.

U.S. Pat. No. 6,991,667 to Yang et al. shows a dust cup ("contaminant collecting receptacle") supported on a coaxial filter case to provide a direct suction path between the motor below it and the cyclone chamber above it. The filter case provides an extra stage of filtration and dust separation for the air exiting the cyclone chamber through the dust cup into the motor housing. The filter case is securely fixed to an annular lever/seal member that surrounds and seals the airflow path from the filter to the motor housing; the dust cup is detachable from the filter case. The annular lever/seal member is mounted to rotate as a unit on a cam structure on the motor housing cover, raising the lever/seal assembly and filter case up and down, and thus raising and lowering the dust cup into and out of engagement with the cyclone chamber.

SUMMARY OF THE INVENTION

According to the invention, a vacuum cleaner comprises a housing with a cyclone separation chamber and a dust cup removably mounted beneath the cyclone separation chamber. The cyclone separation chamber has an inlet opening and an outlet opening. An exhaust conduit extends through the dust cup between the cyclone separation outlet opening and a discharge opening in a bottom wall of the dust cup. A latching mechanism is positioned beneath the dust cup for raising dust cup into engagement with the cyclone separation chamber and for lowering the dust cup from engagement with the cyclone chamber. A suction source has an inlet opening in communication with the exhaust conduit when the dust cup is in engagement with the cyclone separation chamber. A seal member is mounted on the housing beneath the dust cup in sealing relationship with the dust cup and for selective movement between a raised position and a lowered position. A slide lock member is in sliding engagement with the annular seal member and is movable laterally along a slide axis between a latched and a release position relative to the housing to raise and lower the seal member and thus raise and lower the dust cup into and out of engagement with the cyclone separation chamber.

In one embodiment, the vacuum cleaner further comprises a filter case having filter mounted therein and in fluid communication with the dirt cup discharge opening and with the inlet opening of the suction source, and the filter case is removably mounted to the dirt cup.

In a preferred embodiment, the slide-lock member movably mounts the annular seal member in guide slots.

In one embodiment, the housing has a pair of posts spaced from each other and the slide-lock member has a pair of channels that receive the posts to guide the movement of the slide-lock member with respect to the housing. Preferably, the slide-lock member is generally U-shaped and includes a pair of spaced arms, and the channels are formed in the arms.

In one embodiment, the slide-lock member further comprises a pair of guide slots at an upper surface thereof in registry with the channels, and the posts further comprise retainers that overly the guide slots to retain the slide-lock member on the posts. Preferably, the retainers are washers that are removably mounted to an upper portion of the posts.

In another embodiment, the upper ends of guide posts include reduced-diameter bosses that ride in guide slots. In addition, there are two posts that are received in each channel. Further, the limits of the movement of the slide-lock member with respect to the housing are defined by the position of the posts in the channels.

In a preferred embodiment, slot covers removably mounted on the slide-lock member over the guide slots.

In another embodiment, the sidewalls of the slide lock arms are provided with tracks that extend at an acute angle to the slide axis and mount laterally extending arms of the seal member. Further, the outer ends of the tracks are higher than their inner ends thereof whereby pushing the slide lock fully into housing forces the dust cup into sealing engagement with the cyclone separation chamber. Further, outer ends of the tracks level off to secure the seal in its fully raised position.

In another embodiment, friction latches between the slide-lock member and the housing to releasably retain the slide-lock member in the latched position.

In a further embodiment, the slide lock member is generally U-shaped and includes cam guides that slidingly engage lateral arms on the seal assembly to raise and lower the seal member. In yet another embodiment, the seal assembly is annular in shape.

These and other features and advantages of the invention will be apparent on further reading of the detailed description below, in light of the accompanying drawings.

DETAILED DESCRIPTION OF THE INVENTION

Figure 1:
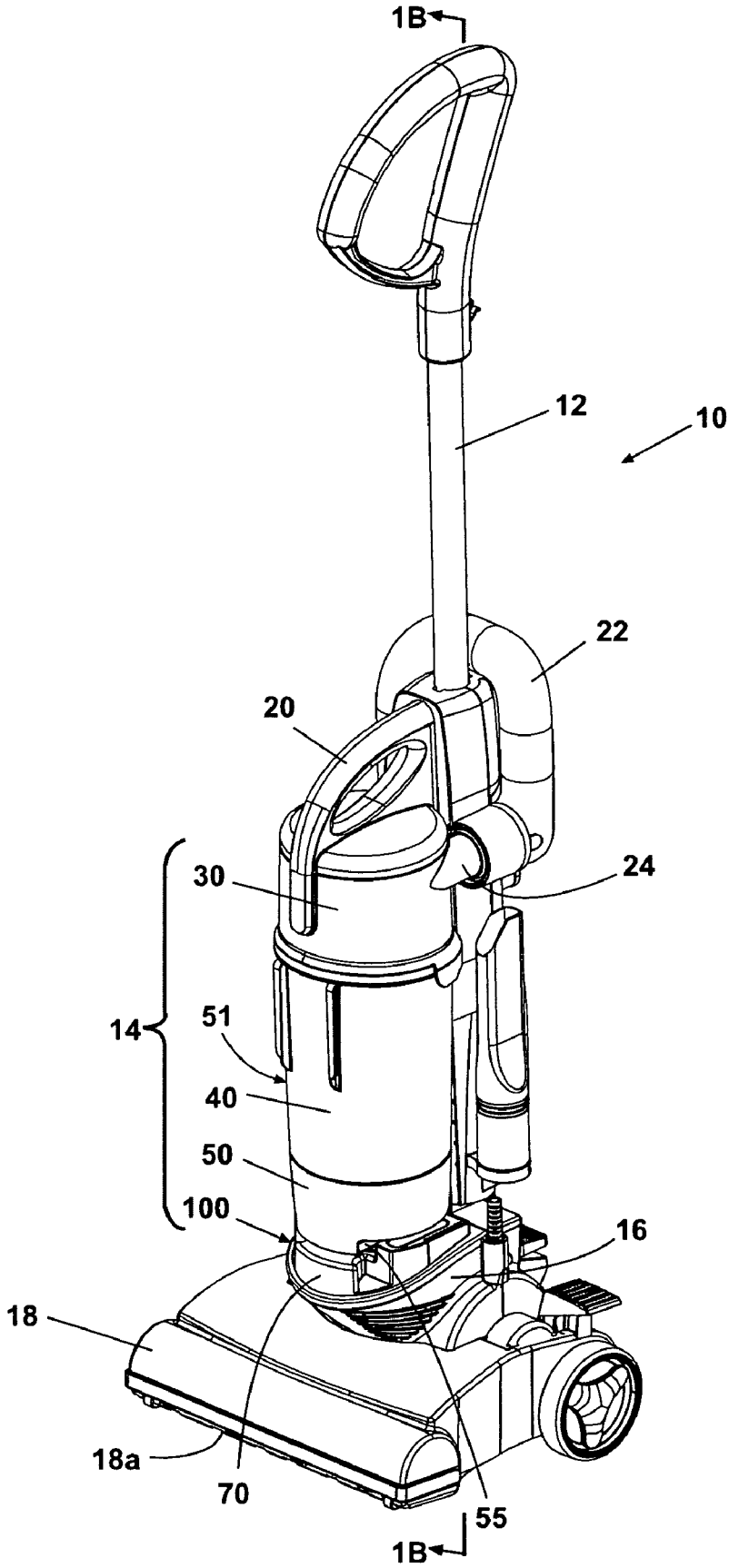
FIG. 1 is a front perspective view of an upright vacuum cleaner with a dust cup assembly and latching mechanism according to the invention.
Figure 1A:
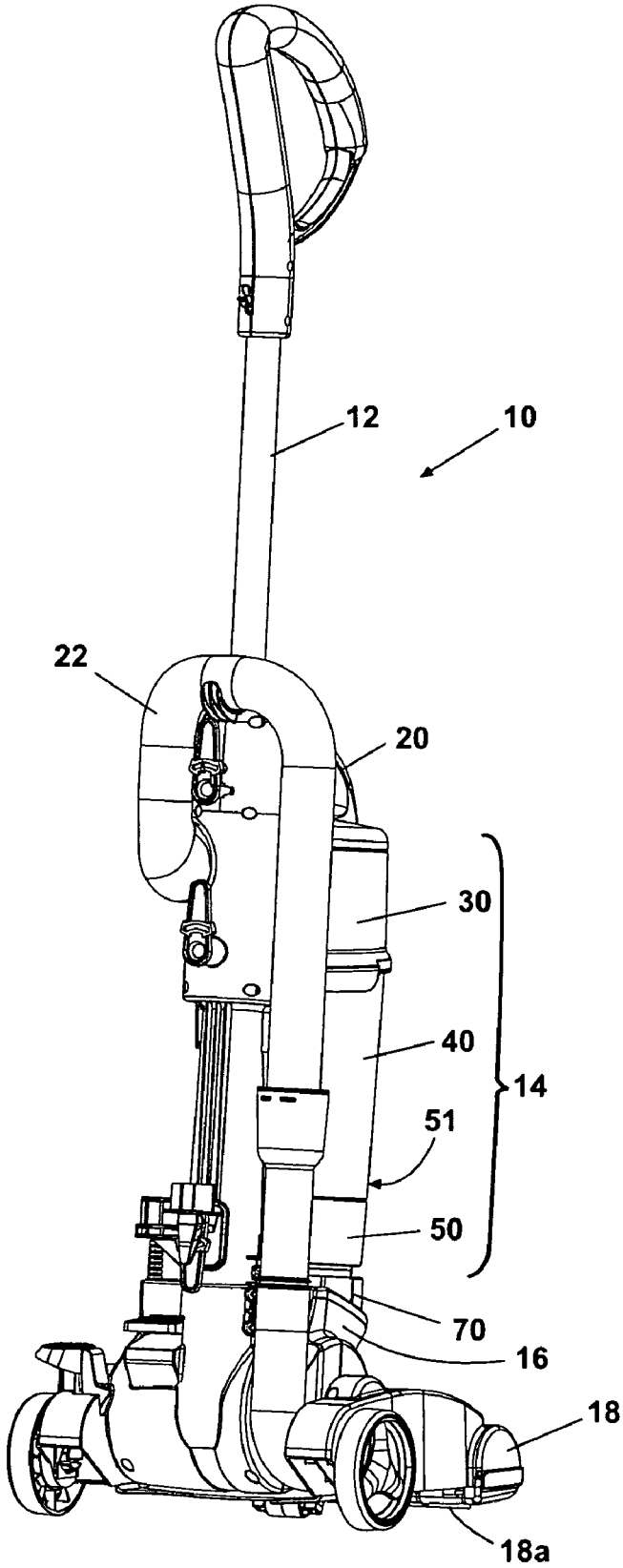
FIG. 1A is a rear perspective view of the vacuum cleaner of FIG. 1.
Figure 1B:
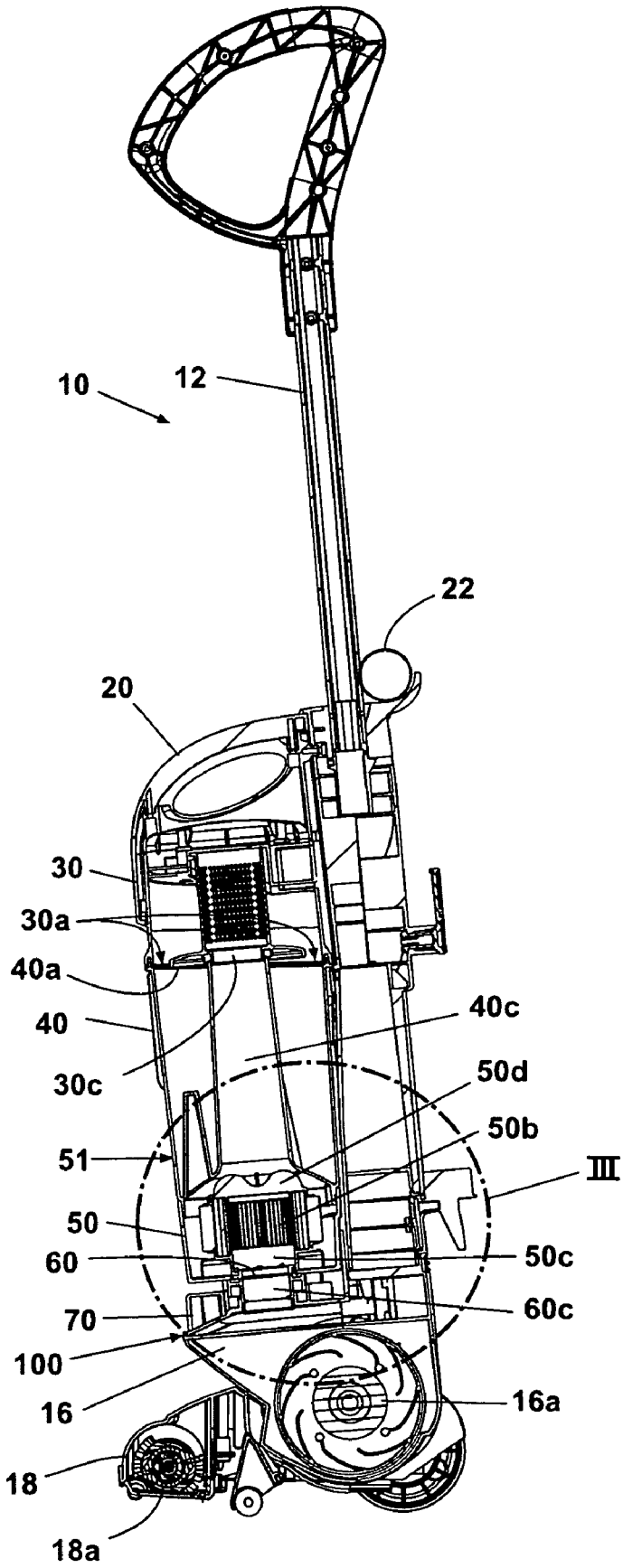
FIG. 1B is a cross-sectional, side elevation view of the vacuum cleaner taken along lines 1B-1B of FIG. 1.

Referring first to FIGS. 1, 1A and 1B, a cyclone-separation type upright vacuum cleaner is shown at 10. The vacuum cleaner 10 has an operating handle 12; a cleaner body 14 including a cyclone chamber 30, a dust-collecting cup 40, and a filter case 50; a vacuum body 16 containing an internal suction-generating vacuum motor 16*a* (FIG. 1A); a brush housing 18 with a rotating brush 18*a* ; and a carry handle 20. A suction passage 22 is connected to receive dirt- and dust-laden air drawn in through the brush housing 18 in known manner and to deliver it in known cyclone-generating fashion to cyclone separator chamber 30 through a cyclone inlet 24.

The cyclone chamber 30 centrifugally separates dirt, dust, and other debris (hereafter collectively "dust") from the swirling airflow in the chamber in known fashion. The separated dust moves to the outer wall of the cyclone chamber 30 via inertia and falls down through one or more peripheral passages 30*a* (FIG. 1B) in the lower end of cyclone chamber 30 that communicate with the open upper end 40*a* of dust cup 40, while the cleaned air passes through a grill assembly 30*b* and into a central discharge passage 30*c*. The cyclone discharge passage 30*c* communicates with a vacuum motor inlet 16*b* of known type (not shown) within the cleaner body 14, through aligned discharge passages 40*c* and 50*c* in dust cup 40 and filter case 50, and further through a bore 60*c* of an annular seal member 60 mounted on a dust cup base 100 on the vacuum body 16. The upper inlet end of discharge passage 50*c* in filter case 50 includes a secondary filter element 50*b* with a cover 50*d* to separate and/or filter out any fine dust remaining in the discharge airflow before it is exhausted from the vacuum cleaner.

The dust cup 40 and filter case 50 is collectively referred to as a dust cup assembly 51. The dust cup 40 and filter case 50 are separate assemblies, removably connected with a friction-fit lap joint 45 (best shown in FIGS. 3 and 4), and can accordingly be removed as a unit from the vacuum cleaner 10. The filter case 50 can subsequently be detached from the dust cup 40 to be emptied and cleaned on its own. Alternately, the dust cup assembly 51 can be an integrated (non-separable) dust cup and filter case, or a dust cup without a separate, secondary filtration structure.

Figure 2:
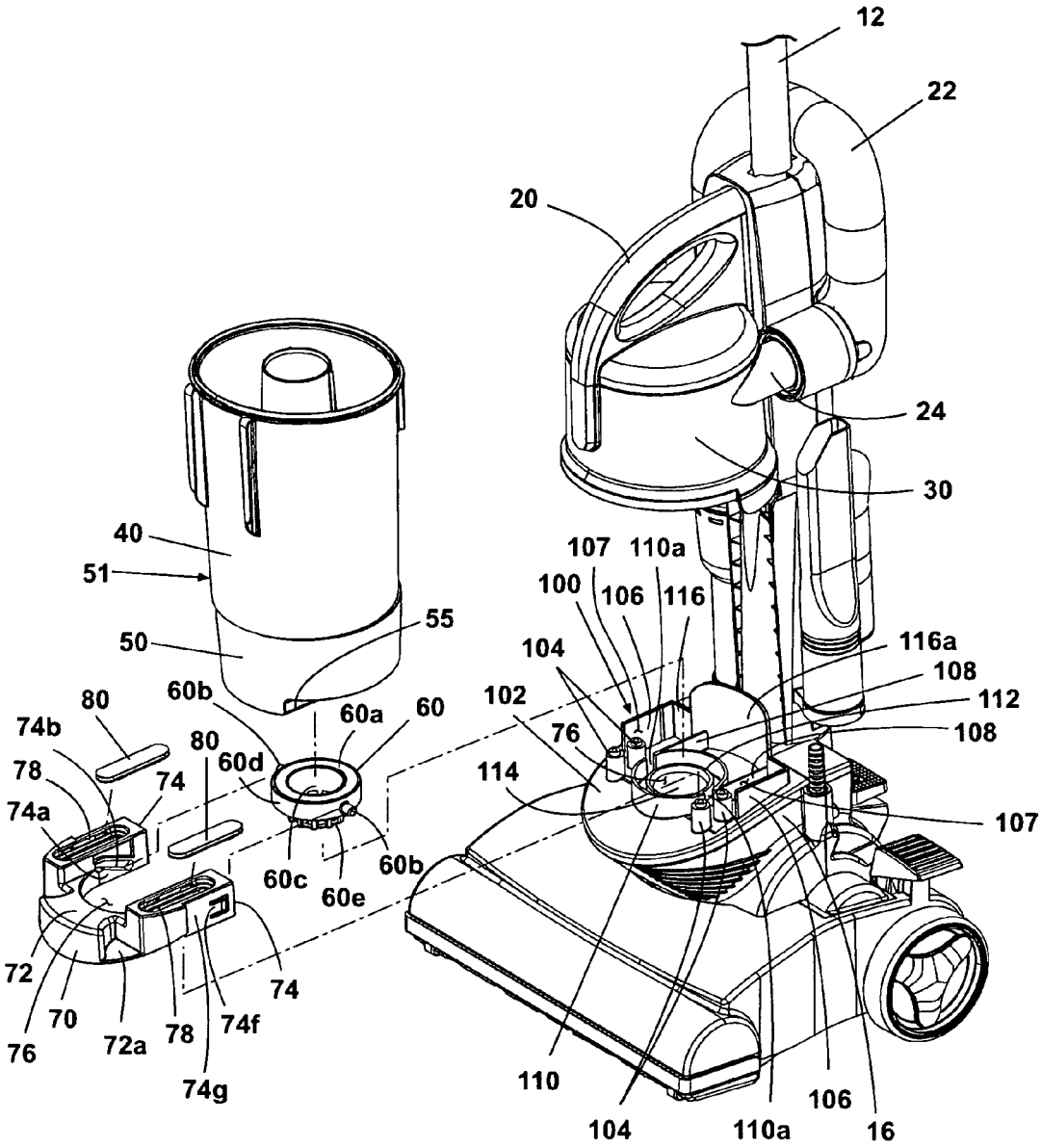
FIG. 2 is an exploded front perspective view of the dust cup assembly and latching mechanism of the vacuum cleaner of FIG. 1.
Figure 3:
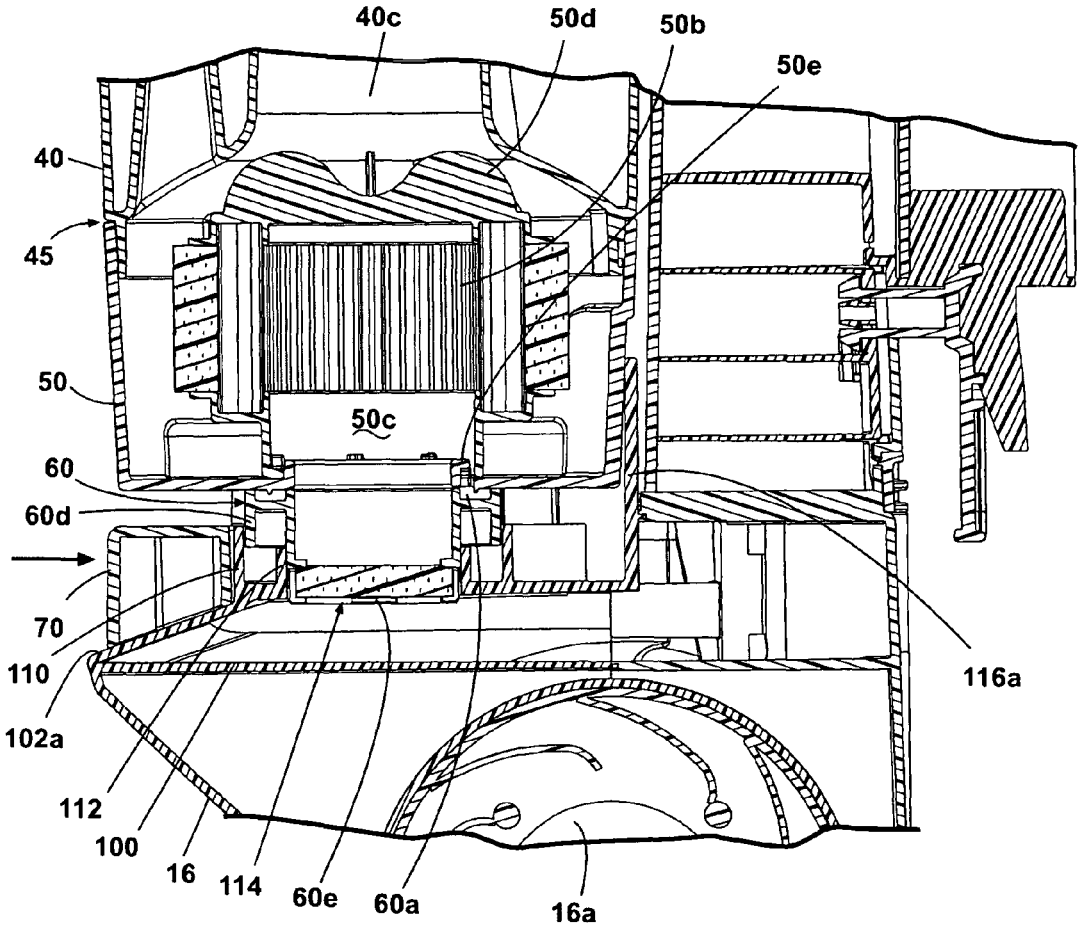
FIG. 3 is an enlarged, cross-sectional, side elevation view of the circled lower portion III of FIG. 1B, illustrating the lower end of the dust cup assembly and the latching mechanism of FIG. 2A, with the latch engaged and the dust cup assembly raised against the cyclone chamber.

As best shown in FIGS. 2 and 3, a lower outlet end 50*e* of filter case 50 rests on an upper sealing face 60*a* of the seal member 60. A lower end 60*e* of seal member 60 is in fluid communication with the vacuum motor inlet 16*b* in the dust cup base 100 on motor housing 16. The seal member 60 is trapped for up-and-down movement on collar structure 110, 112 around the vacuum motor inlet 16*b*. A generally U-shaped slide lock member 70 is mounted to slide generally horizontally in and out on the dust cup base 100 in a substantially straight path, in sliding contact with portions of the trapped seal member 60 to cam the seal member up and down. FIGS. 1, 1A, 1B, and 3 show the slide lock 70 in its fully-inserted latching position, in which the seal member 60 is raised to its uppermost position, in turn raising the dust cup assembly 51 to secure the upper end of dust cup 40 against the bottom of cyclone chamber 30 for vacuum operation.

As best shown in FIGS. 1 and 2, the bottom of filter case 50 is preferably shaped with cutouts or relief areas 55 on each side to provide clearance for the slide lock member 70.

Figure 2A:
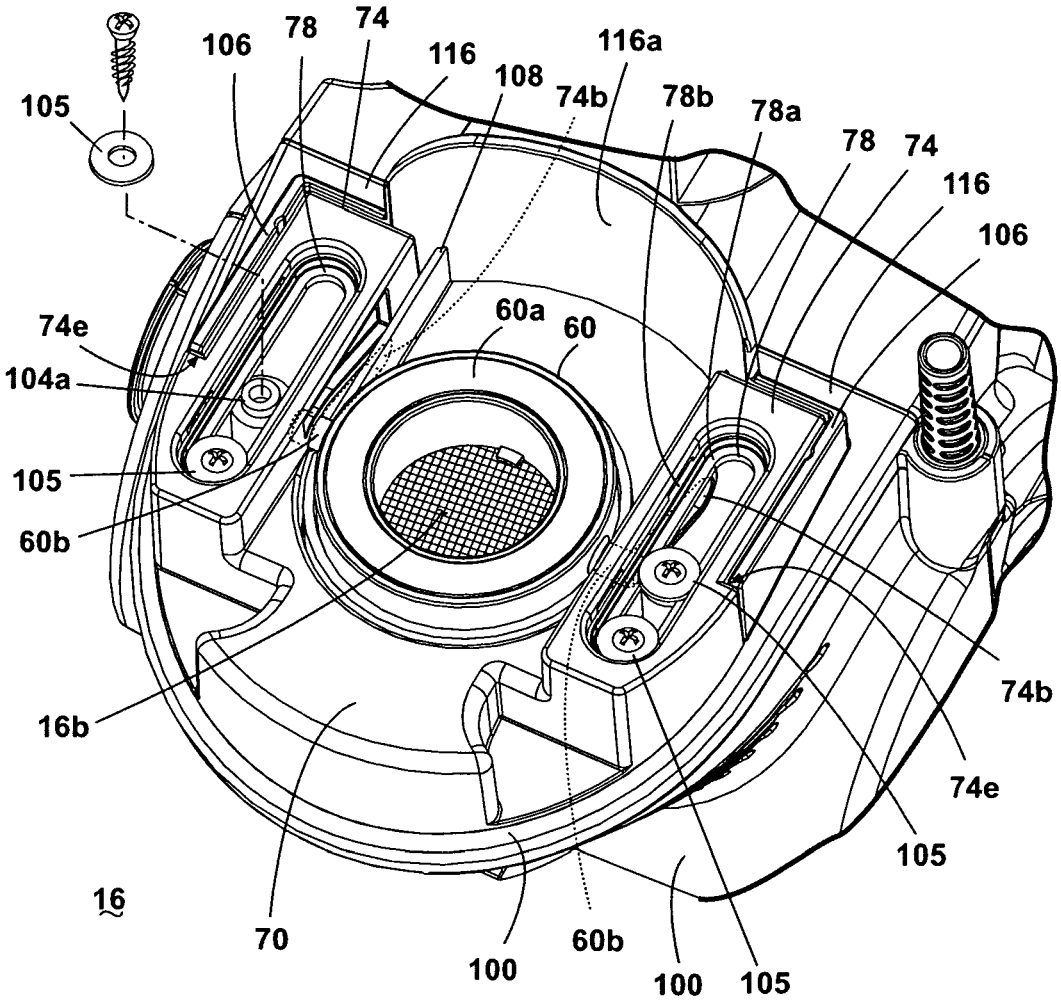
FIG. 2A is an enlarged perspective view of the latching mechanism of FIG. 1 in its latch-engaged position.

Referring to FIGS. 2 and 2A, the dust cup base 100 includes a sliding surface 102 with a downwardly-angled outer end 102*a*, guide posts 104 formed on each side of vacuum motor inlet 16*b*, outer guide walls 106 and inner guide walls 108 forming channels 107 aligned with guide posts 104, and the earlier-mentioned retaining and support collars 110 and 112 surrounding the vacuum motor inlet 16*b*. A rear wall 116 and a curved backstop portion 116*a* conforms to and supports a back side of the dust cup assembly 51.

Figure 4:
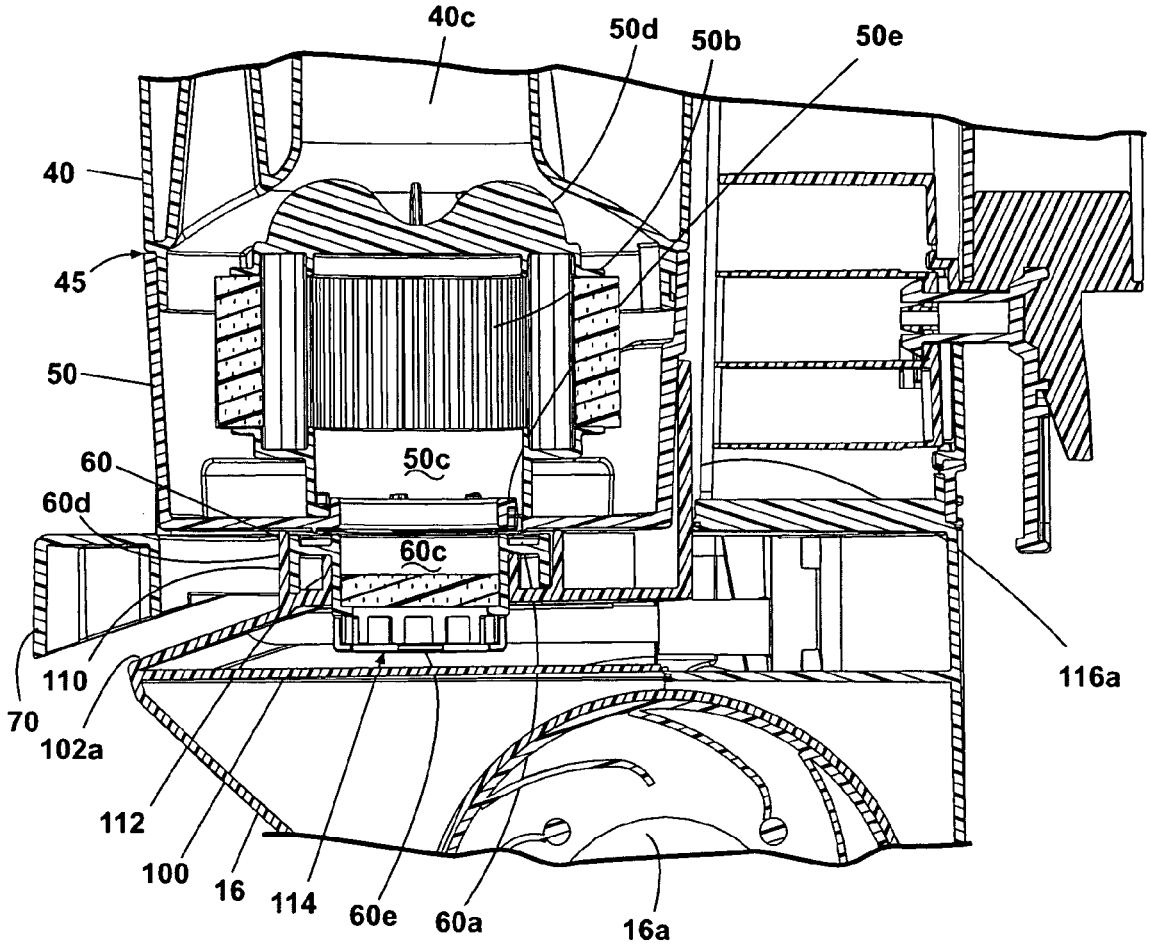
FIG. 4 is a view like FIG. 3, but with the latch disengaged and the dust cup assembly lowered away from the cyclone chamber, so that the dust cup can be removed for emptying.

The seal member 60 has lateral arms 60*b* that ride in vertical slots 110*a* on the outer retaining collar 110. An upper end 60*d* of the seal member 60 is raised off the upper edge of collar 112 when the seal member 60 is raised to its dust-cup-securing position by the slide lock 70 (FIG. 3), and rests on the upper edge of inner collar 112 when the seal member 60 is in its lowermost, dust-cup-detaching position (FIG. 4). The lower end 60*e* of the seal member 60 rides up and down and is in fluid communication with vacuum motor inlet 16*b* between the raised and lowered positions.

The slide lock 70 is a generally U-shaped member with an outer handle portion 72; hollow, open-ended and open-bottomed arms 74 sized to slide over guide posts 104 in channels 107 between walls 106 and 108; a seal-admitting opening 76 sized to slide back and forth past outer retaining collar 110 and seal member 60; and guide slots 78 sized to be trapped in sliding fashion on the upper ends of guide posts 104. A lower surface 72*a* of the outer end of the slide lock 70 is angled downwardly to mate with the angled front ramp portion of sliding surface outer end 102*a* of dust cup base 100 when the slide lock 70 is fully inserted. A pair of covers 80 fit over guide slots 78 in a removable snap-fit fashion, providing access to the sliding connection between the guide posts 104 and the slide lock 70.

Still referring to FIGS. 2 and 2A, the upper ends of guide posts 104 include reduced-diameter bosses 104*a* that ride in guide slots 78, protruding sufficiently to mount retainers such as screw-secured washers 105 (phantom lines) for a sliding fit on a lower shelf 78*a*. An upper shelf 78*b* defines a mating recess for slot covers 80. The open inner ends of slide lock arms 74 abut rear wall 116 when the slide lock is fully inserted, and the outer guide post pins 104*a* abut the outer ends of slots 78. Optional shoulders 74*e* can be formed on outer sidewalls 74*g* of arms 74 to abut the outer ends of outer guide walls 106, as shown. The outer sidewalls 74*g* of arms 74 can also be provided with friction latches 74*f* (FIG. 2) for releasably engaging mating portions of walls 106 to more securely latch the slide lock 70 in its fully inserted position.

Inner sidewalls 74*a* of the slide lock arms 74 include angled tracks 74*b* extending partly or fully through the inner sidewalls, sized and located to trap and slidingly engage the lateral arms 60*b* of seal member 60 as the slide lock 70 moves in and out of the dust cup base 100. The outer ends of cam slots 74*b* are higher than their inner ends, so that pushing the slide lock fully into the dust cup base 100, as shown in FIG. 2A, forces lateral arms 60*b* and seal 60 up. As shown in the illustrated example, the upper, outer ends of cam slots 74 preferably level off for a short distance of horizontal travel, to help secure the seal 60 in its fully raised position.

Pulling the slide lock 70 out of dust cup base 100 correspondingly forces the lateral arms 60*b* and seal 60 down. The slide lock 70 is limited in its outward travel by the sliding connections between the guide slots 78 and the guide posts 104, and between the cam slots 74*b* and the seal member 60.

The sectioned side views of FIGS. 3 and 4 show the fully raised and fully lowered positions of the seal member 60 in response to the insertion and withdrawal of the slide lock 70, and the corresponding fully raised and fully lowered positions of the dust cup assembly 51.

FIG. 3 shows the slide lock 70 fully inserted, with the handle portion 72 resting on base ramp 102*a*. The seal member 60 is raised off the inner collar 112, while the lower end 60*e* of the seal member 60 remains in fluid communication with the vacuum motor inlet 16*b*. The filter case 50 and dust cup 40 are raised such that the upper end of the dust cup 40 is in its sealed dust-collecting position against the cyclone chamber 30 (FIG. 1). The dust cup assembly is supported on the upper surface of seal member 60.

FIG. 4 shows the slide lock 70 disengaged or pulled out from dust cup base 100 to the limit of its travel, forcing the seal member 60 downwardly against the discharge collar 1 12. The dust cup assembly 51 is accordingly lowered out of engagement with cyclone chamber 30 to rest on seal member 60, guide walls 106 and 108, and slide lock arms 74. The dust cup assembly 51 can then be removed as a unit from the vacuum cleaner 10 by simply lifting and pulling it out of the dust cup base 100.

It will be understood that the disclosed embodiments are illustrative rather than definitive of the invention. The illustrated upright vacuum cleaner is but one example of the variety of cyclone-separating type vacuum cleaners with which the invention can be used. Reasonable variation and modification are possible within the scope of the foregoing disclosure and drawings without departing from scope of the invention which is defined by the appended claims.

What is claimed is:

1. In a suction type vacuum cleaner comprising a housing with a cyclone separation chamber and a dust cup removably mounted beneath the cyclone separation chamber, the cyclone separation chamber having an inlet opening and an outlet opening; an exhaust conduit extending through the dust cup between the cyclone separation outlet opening and a discharge opening in a bottom wall of the dust cup; a latching mechanism positioned beneath the dust cup for raising dust cup into engagement with the cyclone separation chamber and for lowering the dust cup from engagement with the cyclone chamber, and a suction source having an inlet opening in communication with the exhaust conduit when the dust cup is in engagement with the cyclone separation chamber, an improved latching mechanism comprising:

an annular seal member mounted on the housing beneath the dust cup in sealing relationship with the dust cup and for selective movement between a raised position and a lowered position; and a slide lock member in sliding engagement with the annular seal member, the slide lock member movable laterally along a slide axis between a latched and a release position relative to the housing to raise and lower the seal member and thus raise and lower the dust cup into and out of engagement with the cyclone separation chamber.

2. The latching mechanism of claim 1 and further comprising a filter case having a filter mounted therein and in fluid communication with the dirt cup discharge opening and with the inlet opening of the suction source, the filter case being removably mounted to the dirt cup.

3. The latching mechanism of claim 1, wherein the slide-lock member movably mounts the annular seal member in guide slots.

4. The latching mechanism of claim 3, wherein the housing has a pair of posts spaced from each other and the slide-lock member has a pair of channels that receive the posts to guide the movement of the slide-lock member with respect to the housing.

5. The latching mechanism of claim 4, wherein the slide-lock member is generally U-shaped and includes a pair of spaced arms, and the channels are formed in the arms.

6. The latching mechanism of claim 5 wherein sidewalls of the slide lock arms are provided with tracks that extend at an acute angle to the slide axis and mount laterally extending arms of seal member.

7. The latching mechanism of claim 6 wherein the outer ends of the tracks are higher than their inner ends thereof whereby pushing the slide lock fully into housing forces the dust cup into sealing engagement with the cyclone separation chamber.

8. The latching mechanism of claim 7 wherein outer ends of the tracks level off to secure the seal in its fully raised position.

9. The latching mechanism of claim 4 wherein the slide-lock member further comprises a pair of guide slots at an upper surface thereof in registry with the channels, and the posts further comprise retainers that overly the guide slots to retain the slide-lock member on the posts.

10. The latching mechanism of claim 9 wherein the retainers are washers that are removably mounted to an upper portion of the posts.

11. The latching mechanism of claim 9 wherein the upper ends of guide posts include reduced-diameter bosses that ride in guide slots.

12. The latching mechanism of claim 11 wherein there are two posts that are received in each channel.

13. The latching mechanism of claim 12 wherein the limits of the movement of the slide-lock member with respect to the housing are defined by the position of the posts in the channels.

14. The latching mechanism of claim 9 and further comprising slot covers removably mounted on the slide-lock member over the guide slots.

15. The latching mechanism of claim 1 and further comprising friction latches between the slide-lock member and the housing to releasably retain the slide-lock member in the latched position.

* * * * *